US008493310B2

(12) United States Patent
Lee et al.

(10) Patent No.: US 8,493,310 B2
(45) Date of Patent: Jul. 23, 2013

(54) LIQUID CRYSTAL DISPLAY DEVICE HAVING TIME CONTROLLER AND SOURCE DRIVER THAT CAN REUSE INTELLECTUAL PROPERTY BLOCKS

(75) Inventors: Jae-youl Lee, Yongin-si (KR); Dae-jin Park, Daegu (KR); Jong-seon Kim, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 949 days.

(21) Appl. No.: 12/071,015

(22) Filed: Feb. 14, 2008

(65) Prior Publication Data

US 2008/0204388 A1 Aug. 28, 2008

(30) Foreign Application Priority Data

Feb. 26, 2007 (KR) ..... 10-2007-0019132

(51) Int. Cl.
*G09G 3/36* (2006.01)

(52) U.S. Cl.
USPC ..... 345/99

(58) Field of Classification Search
USPC ..... 345/87–104
See application file for complete search history.

(56) References Cited

U.S. PATENT DOCUMENTS

| | | | | |
|---|---|---|---|---|
| 4,750,813 | A | 6/1988 | Ohwada et al. | |
| 6,954,201 | B1 | 10/2005 | Ludden et al. | |
| 2005/0062711 | A1 * | 3/2005 | Kobayashi | 345/100 |
| 2005/0110732 | A1 * | 5/2005 | Kim | 345/87 |
| 2007/0120811 | A1 * | 5/2007 | Kudo et al. | 345/103 |
| 2007/0273632 | A1 * | 11/2007 | Kishimoto et al. | 345/98 |
| 2010/0225620 | A1 * | 9/2010 | Lee | 345/204 |

FOREIGN PATENT DOCUMENTS

| | | | |
|---|---|---|---|
| CN | 1386259 | A | 12/2002 |
| CN | 1588509 | A | 3/2005 |
| JP | 2001/092422 | | 4/2001 |
| KR | 10-2003-0073073 | A | 9/2003 |
| KR | 10-2005-0104489 | A | 11/2005 |
| WO | WO 2007108574 | A1 * | 9/2007 |

OTHER PUBLICATIONS

Chinese Office action in CN 200810081705.5 dated Nov. 10, 2011 (Lee, et al.).

* cited by examiner

*Primary Examiner* — Chanh Nguyen
*Assistant Examiner* — Sanghyuk Park
(74) *Attorney, Agent, or Firm* — Lee & Morse, P.C.

(57) ABSTRACT

A liquid crystal display (LCD) apparatus includes a time controller and a plurality of source drivers. The time controller may receive first data, and output a plurality of clock signals and a plurality of pieces of second data to display the first data. The plurality of source drivers may receive the plurality of pieces of second data and the plurality of clock signals from the time controller, convert the plurality of pieces of second data to a plurality of pieces of analog data, and output the plurality of pieces of analog data to a display panel. The time controller may be connected to the plurality of source drivers in a point-to-point fashion. The second data have a packet data format.

18 Claims, 7 Drawing Sheets

LIQUID CRYSTAL DISPLAY DEVICE HAVING TIME CONTROLLER AND SOURCE DRIVER THAT CAN REUSE INTELLECTUAL PROPERTY BLOCKS

BACKGROUND OF THE INVENTION

1. Field of the Invention

Embodiments relate to a liquid crystal display (LCD) apparatus including a source driver and a time controller. More particularly, embodiments relate to a LCD apparatus that can reuse intellectual property (IP) blocks therein.

2. Description of the Related Art

A conventional LCD apparatus may include a time controller, a plurality of source drivers, and a display panel. The time controller receives image data as first data, temporarily stores the first data, determines the time and location at which the first data is output, and outputs a plurality of pieces of second data. The time controller also includes a clock output unit that outputs a clock signal used to transfer the plurality of pieces of second data.

The source drivers receive the second data and the clock signal, convert the second data into analog signals, and output the analog signals to the display panel. The display panel displays an image according to the output signals of the source drivers.

In the conventional LCD apparatus, the clock output unit and the plurality of source drivers are connected to each other in a multi-drop fashion. However, when a clock signal is transferred in the multi-drop fashion to a source driver distant from the clock output unit the clock signal may be distorted. Also, when a clock signal is transmitted in the multi-drop fashion and a plurality of pieces of second data signal are transferred in synchronization with the clock signal to a source driver, electromagnetic interference (EMI) may occur in the second data signal.

The plurality of pieces of second data are transmitted concurrently from the time controller to the source drivers via signal lines which are connected to each other in the multi-drop fashion. Since the plurality of pieces of second data is transmitted in synchronization with a single clock signal, the plurality of pieces of second data are transmitted with the same timing.

Since a plurality of pieces of second data are concurrently transmitted to the respective source drivers, differential current required for data transmission is applied once at the same time. Accordingly, since current is abruptly required, system stability deteriorates. Also, since data is simultaneously applied to adjacent source drivers, EMI may be significant.

Further, in the conventional LCD apparatus, when the time controller receives the first data and outputs the second data, operating conditions, e.g., data loading times, charge sharing times, etc., for the respective data need to be set separately. In other words, a separate circuit for setting the operating conditions has to be installed in the conventional LCD apparatus.

Also, if display settings, e.g., a resolution, a color depth, the number of channels of each source driver, etc., are varied, the conventional LCD apparatus cannot reuse existing IP blocks. Here, the term 'IP blocks' means functional blocks (semiconductor design modules) manufactured together when the corresponding integrated circuit (IC) is designed, have independent functions, and can be reused. That is, IP blocks are blocks in which functions required to configure logic circuits of a semiconductor are integrated into hardware or software. The source drivers, components in the time controller, etc., may be IP blocks.

Since the conventional LCD apparatus transmits a clock signal through signal lines which are connected to the source drivers in the multi-drop fashion, EMI may be significant. Also, since data is concurrently transferred to all source drivers, system stability deteriorates. Furthermore, whenever a LCD apparatus, source drivers, etc. are replaced, existing IP blocks need to be replaced.

SUMMARY OF THE INVENTION

Embodiments are therefore directed to a LCD apparatus, which substantially overcomes one or more of the problems due to the limitations and disadvantages of the related art.

It is therefore a feature of an embodiment to provide a LCD apparatus that reduces or prevents EMI.

It is therefore another feature of an embodiment to provide a LCD apparatus that can reuse IP blocks even when an operating condition changes.

It is therefore yet another feature of an embodiment to provide a LCD apparatus that reduces power consumption.

At least one of the above and other features and advantages may be realized by providing a liquid crystal display (LCD) apparatus including a time controller configured to receive first data, and to output a plurality of clock signals and a plurality of pieces of second data to display the first data, and a plurality of source drivers configured to receive the plurality of pieces of second data and the plurality of clock signals from the time controller, convert the plurality of pieces of second data to a plurality of pieces of analog data, and output the plurality of pieces of analog data to a display panel, wherein the time controller and the plurality of source drivers have a point-to-point connection, and the second data have a packet data format.

The time controller may include a packet data generator configured to convert the first data into the packet data format and output the converted packet data. The packet data may include a payload part including a data loading time, a charge sharing time, or image data that is to be displayed, and a header having information about data of the payload part.

The number of the plurality of source drivers may be n, and the time controller may output n clock signals having different phases to the n source drivers, respectively. The time controller may include a delay line including a plurality of delay cells, and output the n clock signals having the different phases using the delay line.

The packet data may include information regarding a time at which image data is loaded into the display panel from the plurality of source drivers.

The time controller further may include a controller and buffer memory configured to receive and store the first data, and output a control signal for displaying the first data, a packet data generating unit configured to generate the plurality of pieces of second data in the form of packet data, using the first data, and a data output unit configured to output the plurality of pieces of second data to the plurality of source drivers, respectively.

Each packet data may include a payload part including information regarding a loading time, a time required for loading, or a location of the loaded data, and a header indicating that data of the payload part is data about a loading time, wherein the LCD apparatus adjusts a time at which the second data is loaded.

In the packet data, data loading times of the plurality of pieces of second data may bee set so that the plurality of pieces of second data are loaded at different times. The packet data may be information regarding a charge sharing time which is a time required to change polarities of voltages applied to both ends of a pixel, or image information that is actually displayed.

Each source driver may further include a decoder configured to receive and decode the packet data, and obtain information regarding a loading time and a charge sharing time from the result of the decoding.

A size of the packet data is set differently according to the number of image signals included in the packet data.

The point-to-point connection may include a plurality of first signal lines providing a point-to-point connection of the plurality of clock signals to the plurality of source drivers, and a plurality of second signal lines, separate from the plurality of first signal lines, providing a point-to-point connection of the plurality of pieces of second data to the plurality of source drivers.

The time controller may be configured to receive image data that is to be displayed on one horizontal line of the display panel while a data enable signal is activated. When the second data is transmitted, the LCD apparatus may transmit image data that is to be displayed on one horizontal line of the display panel, as one piece of packet data, to the plurality of source drivers or as at least two pieces of packet data.

The time controller may include a switching unit configured to supply or block supply of a differential current required to transmit the second data from a power supply. The time controller may be configured to sense a time period for which the second data are not transmitted, and turn off the switching unit during the time period for which the second data is not transmitted, in response to the result of the sensing.

The point-to-point connection may include a plurality of signal lines transmitting the plurality of clock signals and the plurality of pieces of second data, the plurality of clock signals being embedded in the plurality of pieces of second data.

The point-to-point connection may include first signal lines connecting the plurality of clock signals to the plurality of source drivers, the plurality of clock signals being less than the plurality of source drivers, and a plurality of second signal lines, separate from the first signal lines, providing a point-to-point connection of the plurality of pieces of second data to the plurality of source drivers. Each clock signal of the plurality of clock signals may be supplied to at least two source drivers.

BRIEF DESCRIPTION OF THE DRAWINGS

The above and other features and advantages of embodiments will become more apparent to those of ordinary skill in the art by describing in detail exemplary embodiments thereof with reference to the attached drawings, in which.

DETAILED DESCRIPTION OF THE INVENTION

Figure 1A:
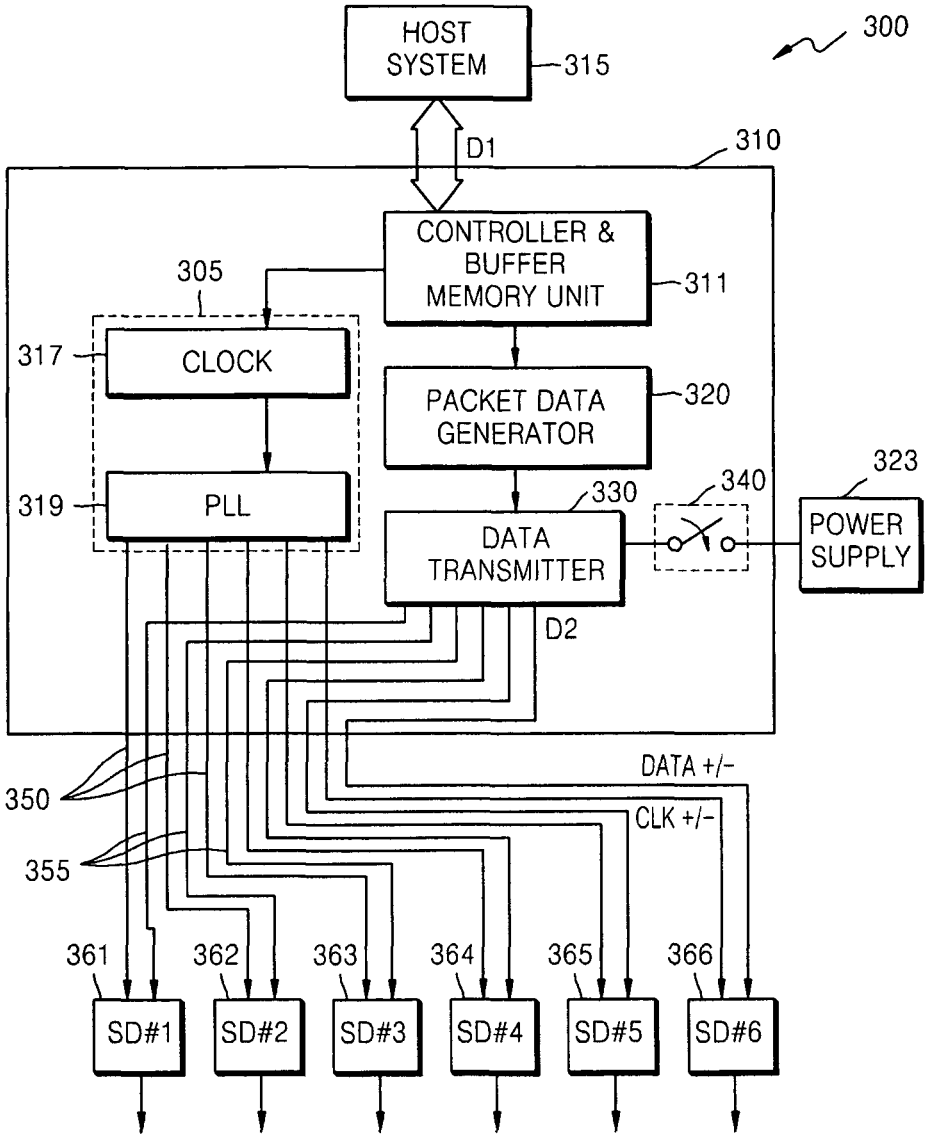
FIG. 1A illustrates a block diagram of an LCD apparatus according to an embodiment.

Korean Patent Application No. 10-2007-0019132, filed on Feb. 26, 2007, in the Korean Intellectual Property Office, and entitled: "Liquid Crystal Display Device Having Time Controller and Source Driver," is incorporated by reference herein in its entirety.

Embodiments will now be described more fully hereinafter with reference to the accompanying drawings, in which exemplary embodiments are illustrated. Embodiments may, however, be embodied in different forms and should not be construed as limited to the embodiments set forth herein. Rather, these embodiments are provided so that this disclosure will be thorough and complete, and will fully convey the scope thereof to those skilled in the art. Like reference numerals refer to like elements throughout.

FIG. 1A illustrates a block diagram of a LCD apparatus 300 according to an embodiment. Referring to FIG. 1A, the LCD apparatus 300 may include a time controller 310 and source drivers (SD#1 through SD#6) 361 through 366.

In FIG. 1A, the LCD apparatus 300 includes six source drivers (SD#1 through SD#6) 361 through 366. However, the number of source drivers is not limited to six, and any number of source drivers may be included.

The time controller 310 may receive first data D1 from an external host system 315, control a location and time at which the first data D1 will be displayed, and output a plurality of pieces of second data D2 to the source drivers 361 through 366. The external host system 315 may be a personal computer (PC), a graphic card, a graphic processor of a TV, etc. The time controller 310 may include a clock output unit (CLOCK) 317, a phase locked loop (PLL) 319, a controller & buffer memory unit 311, a packet data generator 320, and a data transmitter 330.

The clock output unit 317 may generate a clock signal having a predetermined frequency. The predetermined frequency and the generation timing of the clock signal may be adjusted according to the control of the controller & buffer memory unit 311.

The PLL 319 may receive the clock signal generated by the clock output unit 317, and output a plurality of clock signals CLK having respective phase differences to the source drivers 361 through 366. Accordingly, the clock signals CLK output from the PLL 319 have different phases. While the PLL 319 is illustrated in FIG. 1A as being inside the clock output unit 317, the PLL 319 may be outside the clock output unit 317.

The controller & buffer memory unit 311 may receive the first data D1 and a variety of control signals from the host system 315. Then, the controller & buffer memory unit 311 may temporarily store the first data D1, and determine a time and location (address) at which the first data D1 will be displayed, etc., in accordance with the control signals. The variety of control signals may include a horizontal synchronization signal HSYNC and a vertical synchronization signal VSYNC.

The packet data generator 320 may generate packet data, including a header and a payload part, using the first data D1, i.e., image data to be displayed at a pixel, and the variety of control signals output from the controller & buffer memory unit 311. The data transmitter 330 may transfer data output from the packet data generator 320 to the respective source drivers 361 through 366.

The header of the packet data may include information about payload data stored in the payload part. For example, according to a value of the header, the payload data may include information about a time at which data is loaded from a source driver SD to a display panel, an address at which data is located, a charge sharing time which is a time required to change polarities of voltages applied to both ends of a pixel, etc., or may include image information that is to be actually displayed.

The time controller 310 may further include a switching unit 340 between the data transmitter 330 and a power supply 323. The switching unit 340 may prevent a supply voltage from being applied when the data transmitter 330 transfers no data, i.e., during an inactivation period.

The switching unit 340 may be turned on or off by detecting the level of a signal output from the data transmitter 330 and sensing a period for which no data is transferred. That is, by turning off the switch unit 340 in the inactivation period, no supply voltage is applied to the data transmitter 330 from the power supply 323. The supply voltage may generate a differential current.

In FIG. 1A, the switching unit 340 is shown as a switch. However, the switching unit 340 may be a general supply voltage control device. That is, the switch unit 340 may be a power supply control device which detects the level of a signal output from the data transmitter 330 and controls the supplying of power in response to the result of the detection.

The plurality of source drivers 361 through 366 respectively receive the plurality of pieces of second data D2 output from the time controller 310, and output a voltage that is to be applied to both ends of each liquid crystal cell of the display panel (not shown), according to the second data D2. Each source driver SD may be a digital-to-analog converter. Accordingly, each second data D2, which is in the form of a digital signal, may be converted into an analog voltage and then output. Since gradation voltages driving liquid crystal cells vary according to the analog voltages output from the source drivers 361 through 366, the brightness of light output from the liquid crystal cells depends on the analog voltages which are output from the source drivers 361 through 366.

The time controller 310 and the plurality of source drivers 361 through 366 may be connected to each other in a point-to-point fashion. The clock signals CLK may be independently transmitted through a first signal line part 350 in which signal lines are connected to the source drivers 361 through 366 in a point-to-point configuration. The clock signals that are independently transmitted may be clock signals having different phases output from the PLL 319. Alternatively, the clock signals CLK may be clock signals having different phases that have not been subjected to phase delay by the PLL 319.

The time controller 310 and the plurality of source drivers 361 through 366 may be connected to each other in the point-to-point fashion. The plurality of pieces of second data D2 may be independently transmitted in the form of packet data to the respective source drivers 361 through 366, through second signal line parts 355 which are connected to the source drivers 361 through 366 in the point-to-point fashion.

In FIG. 1A, data "DATA +/−" transmitted to the source driver (SD#6) 366 indicates whether data D2 is an inverted or non-inverted differential signal. A clock signal "CLK +/−" transmitted to the source driver (SD#6) 366 indicates whether the clock signal CLK is an inverted or non-inverted differential signal.

Figure 1B:
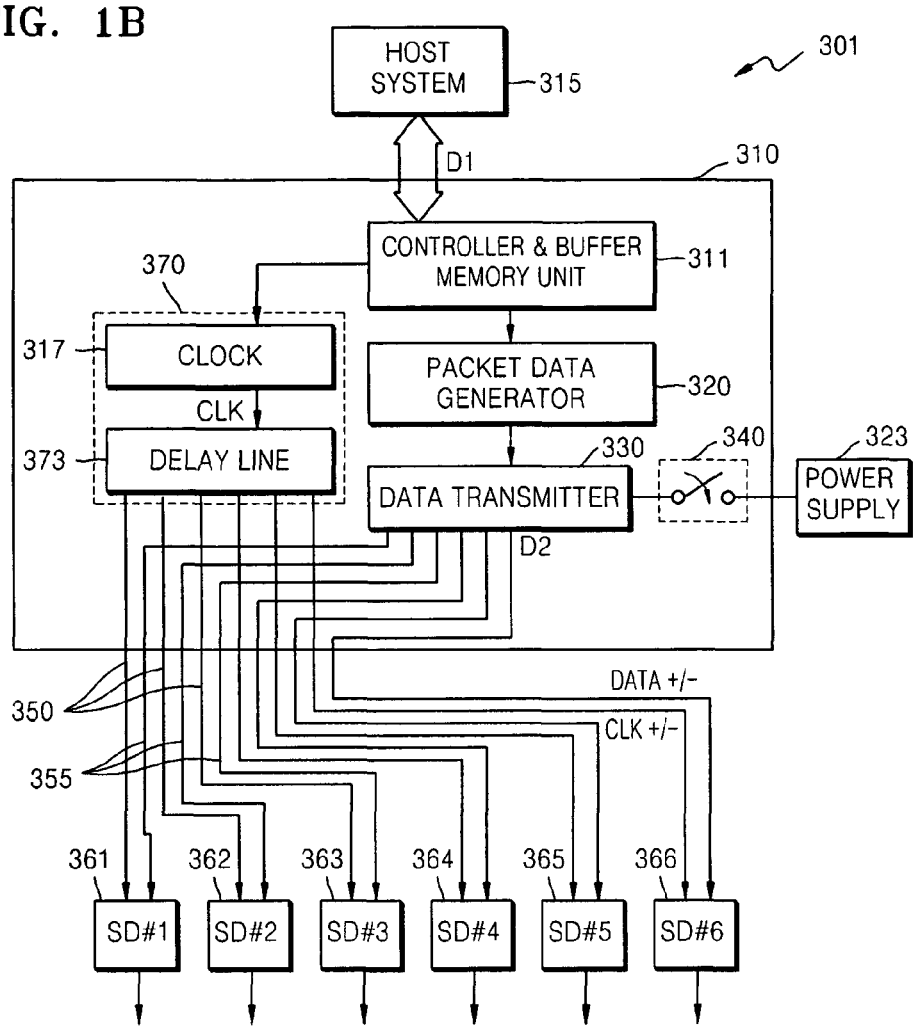
FIG. 1B illustrates a block diagram of an LCD apparatus according to another embodiment.

FIG. 1B illustrates a block diagram of an LCD apparatus 301 according to another embodiment. Referring to FIG. 1B, the LCD apparatus 301 may include a delay line 373 instead of the PLL 319 illustrated in FIG. 1A. The remaining components of the LCD apparatus 301 are the same as those of the LCD apparatus 300 illustrated in FIG. 1A, and accordingly, detailed descriptions thereof will be omitted.

The delay line 373 may receive a clock signal CLK from the clock output unit 317 and delay the clock signal CLK using delay cells. Thus, the delay line 373 may output a plurality of clock signals having different phases. While FIG. 3B shows the delay line 373 installed inside the clock output unit 317, the delay line 373 may be installed outside the clock output unit 317. The delay cells included in the delay line 373 will be described in detail with reference to FIG. 1C, below.

Figure 1C:
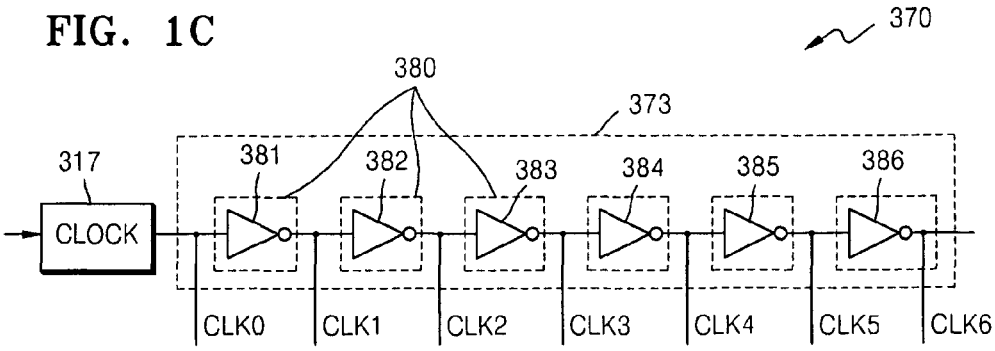
FIG. 1C illustrates a detailed view of a clock device and a delay line illustrated in FIG. 1B.

FIG. 1C illustrates the clock output unit 317 and the delay line 373 illustrated in FIG. 1B. Referring to FIG. 1C, the delay line 373 may include a plurality of delay cells 380. The delay cells 380 may be implemented using a plurality of inverters 381 through 386. When the delay cells 380 are implemented by inverters, an amount of delay may be controlled by adjusting resistance R and capacitance C.

It is assumed that an original clock signal CLK is CLK0, a signal whose phase is delayed by passing through a first inverter 381 is a first clock signal CLK1, a signal whose phase is delayed by passing through two inverters 381 and 382 is a second clock signal CLK2, etc. Accordingly, if the clock signal CLK0 passes through the delay line 373, more clock signals having different phases are output than the number of source drivers in the LCD apparatus 301. The plurality of pieces of second data D2 may be output to the source drivers 361 through 366, in synchronization with the respective clock signals CLK0 through CLK6.

Figure 2A:
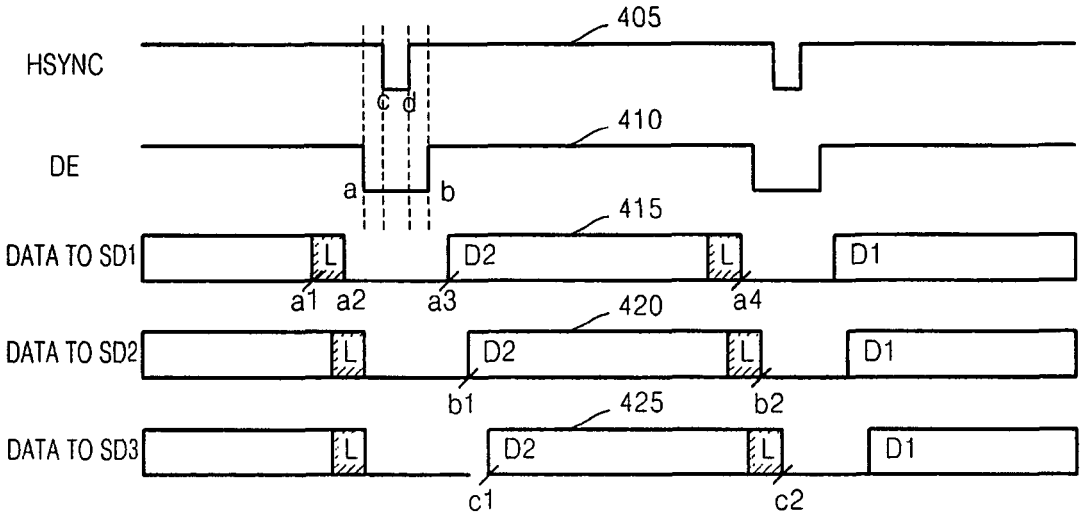
FIG. 2A illustrates timing diagrams of signals or data which are input to or output from the LCD apparatus illustrated in FIG. 1A or FIG. 1B, according to an embodiment.

FIG. 2A illustrates timing diagrams of signals or data input to or output from the LCD apparatus 300 illustrated in FIG. 1A or the LCD apparatus 310 illustrated in FIG. 1B, according to an embodiment. Referring to FIG. 2A, when a data enable signal DE goes "high", first data D1 output from the host system 315 is transmitted to the time controller 310. Second data D2 transferred from the time controller 310 to the first source driver (SD#1) 361 is output at a time a3. Second data D2 transferred to the second source driver (SD#2) 362 is output at a time b1. Second data D2 transferred to the third source driver (SD#3) 363 is output at a time c1, and so forth. As described above, a clock signal passes through the PLL 319 (FIG. 1A) or the delay line 373 (FIG. 1B), generating clock signals having different phases. Thus, a plurality of pieces of the second data are output in synchronization with the clock signals having the different phases, so that the plurality of pieces of data are respectively output at different timings.

Also, data loading times of packet data may be separately set. For example, loading times at which a plurality of pieces of data are loaded into the respective source drivers 361 through 366 may be set differently from each other. For example, the second data D2 transmitted to the first source driver 361 may be loaded at a time a4, and the second data D2 transmitted to the second source driver 362 may be loaded at a time b2, etc. As such, by loading a plurality of pieces of second data at different times, simultaneous switching noise may be reduced and differences between data loading times between source drivers caused by delays of panel gate lines may be compensated.

Figure 2B:
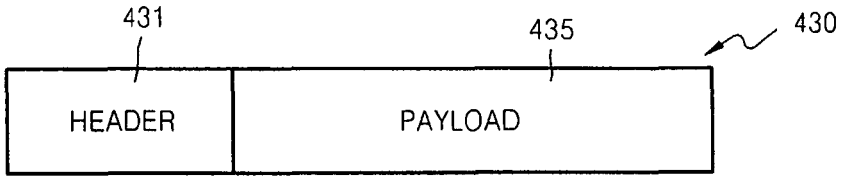
FIG. 2B illustrates a format of second data which is input to or output from the LCD apparatus illustrated in FIG. 1A or FIG. 1B.

FIG. 2B illustrates a format of the second data D2 transmitted to the source drivers 361 through 366 in accordance with an embodiment. Referring to FIG. 2B, the second data D2 may have a format of packet data 430. The packet data 430 may include a header 431 and a payload part 435.

The header 431 may include information about data included in the payload part 435. The payload part 435 may include actual information regarding image data, a loading time, a charge sharing time, etc. The second data D2 may be generated by the packet data generator 320 (see FIG. 1A or FIG. 1B).

Payload data stored in the payload part 435 may include information regarding a data loading time at which the second data D2 is loaded from a source driver to a panel display part, according to a value of the header 431. The payload data may further include a charge sharing time, an address of data, size information of data, and so forth.

For example, assume that the header 431 indicates that the following payload data 435 is a data loading time and the payload data 435 includes a predetermined data loading time. In this case, a source driver SD that receives packet data including the payload data 435 recognizes the packet data as a data loading time, and loads data at the predetermined data loading time. In detail, the source driver SD decodes loading time information included in the second data D2, and loads the second data D2 to a display panel at the corresponding data loading time.

Alternatively, assume that the header 431 indicates that the following payload data 435 is image data and the payload data 435 includes image data. In this case, if the source driver SD receives packet data 430 including the payload data 435, the source driver SD recognizes the packet data 430 as image data.

Accordingly, the LCD apparatus 300 or 301 according to the current embodiment may overcome the problem of a conventional LCD apparatus that existing IP blocks cannot be reused when display settings, e.g., a resolution, a color depth, the number of channels of each source driver, etc., are changed. Also, even when operating conditions, e.g., a charge sharing time, an accurate address of data, size information of data, etc. required for display are changed, the LCD apparatus 300 or 301 according to the current embodiment generates packet data according to the changed information. That is, by generating second data in the form of packet data, existing IP blocks can be reused.

Figure 3:
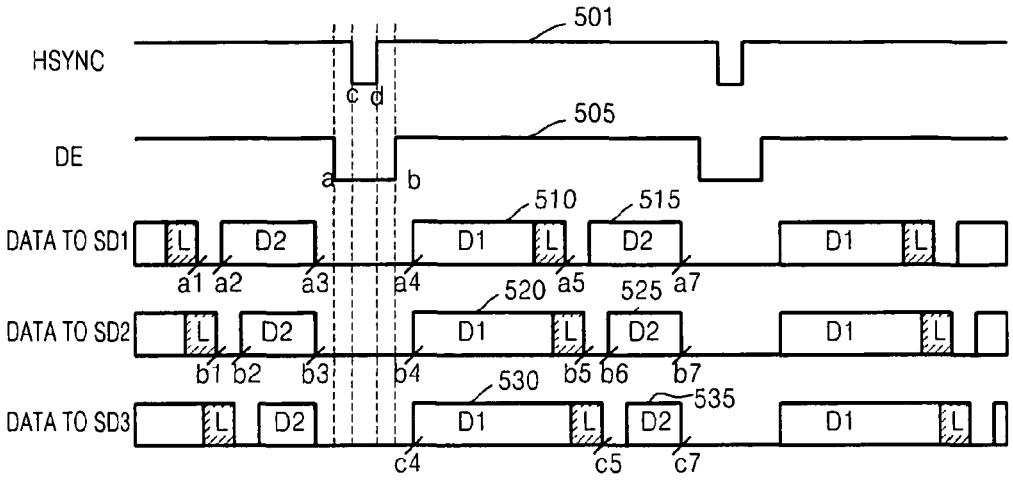
FIG. 3 illustrates timing charts of signals or data which are input to or output from the LCD apparatus illustrated in FIG. 1A or FIG. 1B, according to another embodiment.

FIG. 3 illustrates timing charts of signals or data input to or output from the LCD apparatus 300 illustrated in FIG. 1A or the LCD apparatus 301 illustrated in FIG. 1B, according to another embodiment. Referring to FIG. 3, two pieces of packet data may be transmitted during a data transmission period.

In detail, the amount of data that is to be output to one horizontal line of a display panel may be transmitted during a data transmission period. Data corresponding to one line of the display panel may be divided into two or more pieces of packet data, and the two or more pieces of packet data may be transmitted separately.

Loading times of packet data first transmitted to respective source drivers may be set with predetermined intervals so that the packet data is loaded at different loading times to the respective source drivers. Also, loading times of packet data secondly transmitted to respective source drivers may be set with predetermined intervals so that the packet data is loaded at different loading times to the respective source drivers. That is, the loading times of packet data may be set in such a manner that packet data 510 is loaded at a time a5, packet data 520 is loaded at time b5, packet data 530 is loaded at time c5, and so forth. Also, the loading times of packet data may be set in such a manner that packet data 515, packet data 525, packet data 535, etc., are loaded at different times.

As a result, embodiments may reduce erratic operation of source drivers caused by power noise that results from a large amount of current consumption when analog data is loaded into a LCD panel. Such erratic operation may occur when data transmitted from a time controller cannot be received at a high speed due to instability in the supply voltage of source drivers.

Figure 4A:
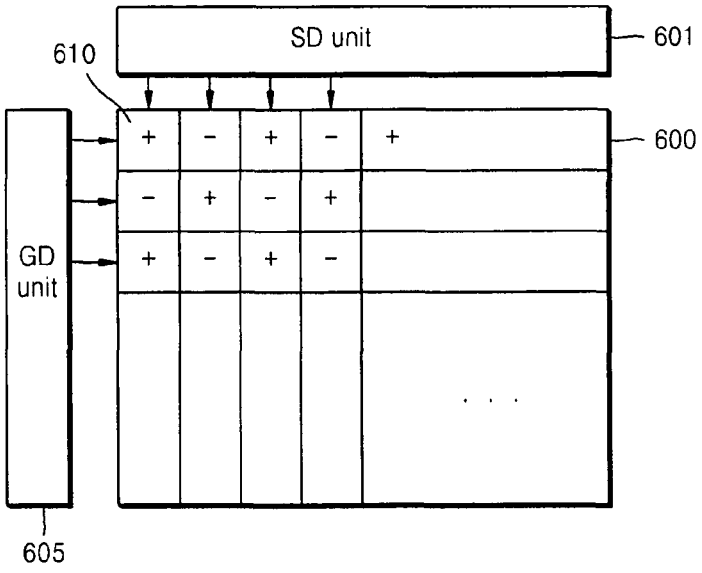
FIG. 4A illustrates a display panel connected to source drivers illustrated in FIG. 1A.

FIG. 4A illustrates a display panel 600 to which the source drivers 361 through 366 illustrated in FIG. 1A or 1B are connected. The display panel 600 may include a plurality of liquid crystal cells 610, a gate driving (GD) unit 605, and a source driving (SD) unit 601.

Since a sharp change in color may appear if the polarities of voltages applied to the liquid crystal cells are all the same, polarities of liquid crystal cells at intersections may be different from each other. As illustrated in FIG. 4A, adjacent liquid crystal cells have different polarities. Also, the polarity of a voltage of each liquid crystal cell may vary continuously.

Figure 4B:
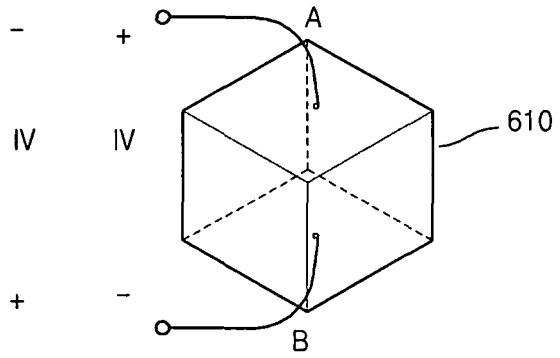
FIG. 4B illustrates a liquid crystal cell included in the display panel illustrated in FIG. 4A.

FIG. 4B illustrates a liquid crystal cell 610 included in the display panel 600 illustrated in FIG. 4A. The brightness of the liquid crystal cell 610 may depend on the amplitude of a voltage applied across the ends of the liquid crystal cell 610. The polarities of voltages of liquid crystal cells 610 may vary continuously. As illustrated in FIG. 4B, (+) and (−) voltages may be respectively applied to A and B terminals so that a voltage difference of 1 volt is generated between the A and B terminals. Then, (−) and (+) voltages may be respectively applied to the A and B terminals so that a voltage difference of 1 volt is generated between the A and B terminals.

Figure 4C:
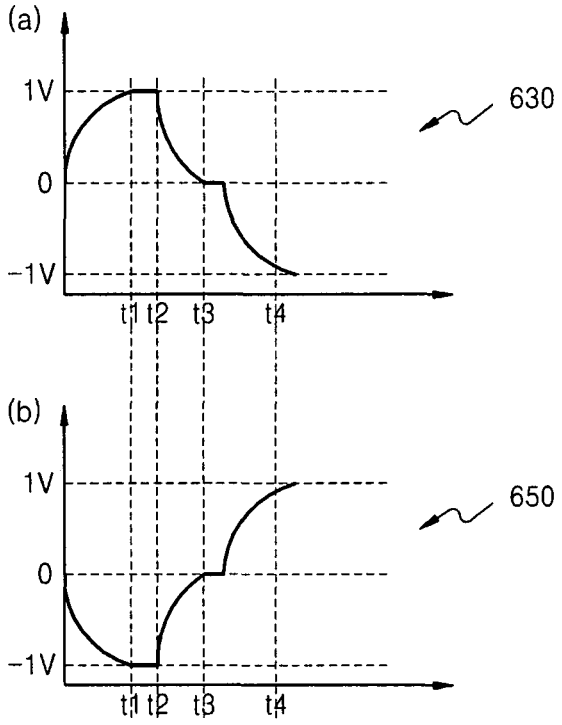
FIG. 4C illustrates graphs plotting differential voltages applied to the liquid crystal cell illustrated in FIG. 4B.

FIG. 4C illustrates graphs plotting a differential voltage which is applied to the liquid crystal cell 610 illustrated in FIG. 4B. A voltage of the A terminal varies as plotted in a graph 630 and a voltage of the B terminal varies as plotted in a graph 650.

When the voltages of the A and B terminals vary, a reference voltage is set to 0 volts and a sum of the two voltages becomes 0 volts. A time required to change the voltage of the A or B terminal from a maximum or minimum voltage to 0 volts is called a charge sharing time. In the current embodiment, the charge sharing time corresponds to a time from t1 to t3. In the current embodiment, the charge sharing time may be changed by including the charge sharing time and a start time in packet data.

Figure 5:
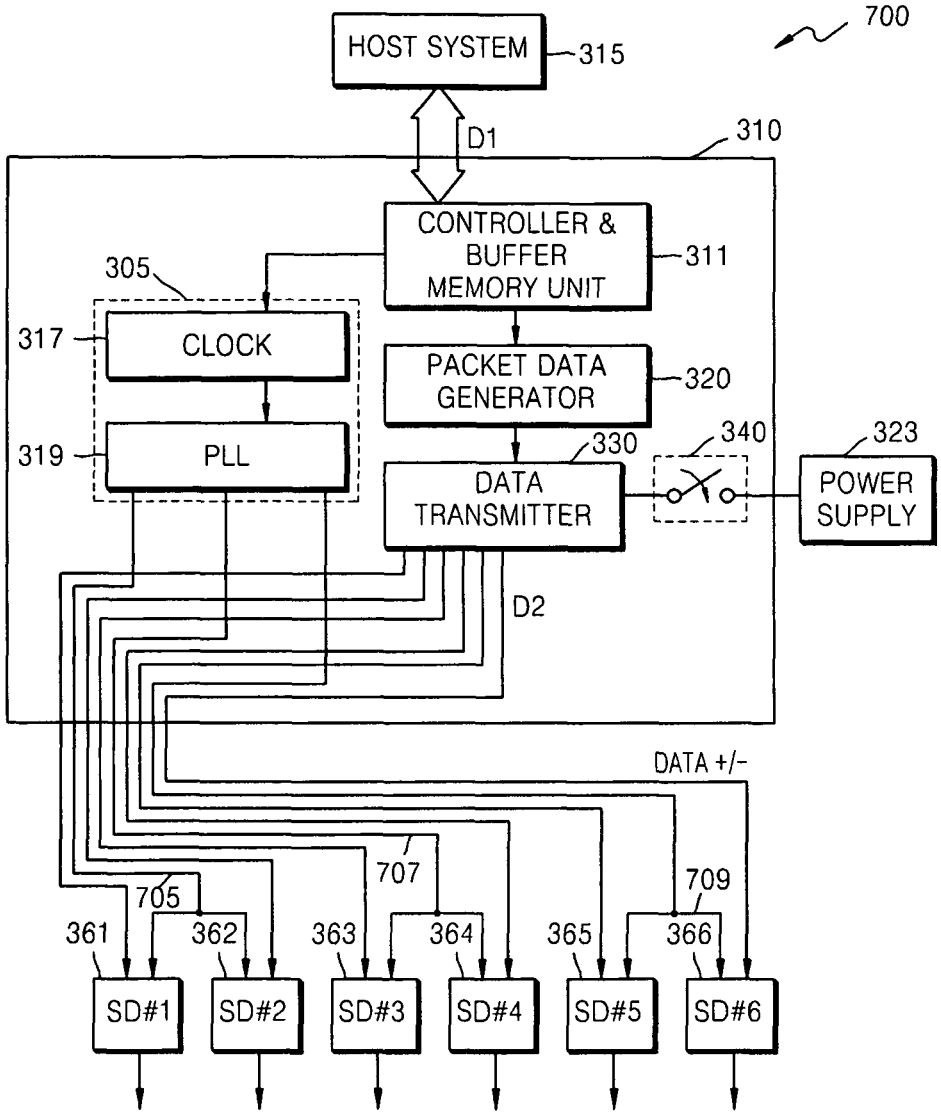
FIG. 5 illustrates a block diagram of an LCD apparatus according to another embodiment.

FIG. 5 illustrates a block diagram of an LCD apparatus 700 according to another embodiment, in which each clock signal line 705, 707, and 709 is connected to two source drivers. The remaining configuration of FIG. 5 is the same as the configuration of FIG. 1A, and accordingly a detailed description thereof will be omitted. Also, it is understood by one of ordinary skill in the art that a clock signal line can be connected to more than two source drivers.

Figure 6:
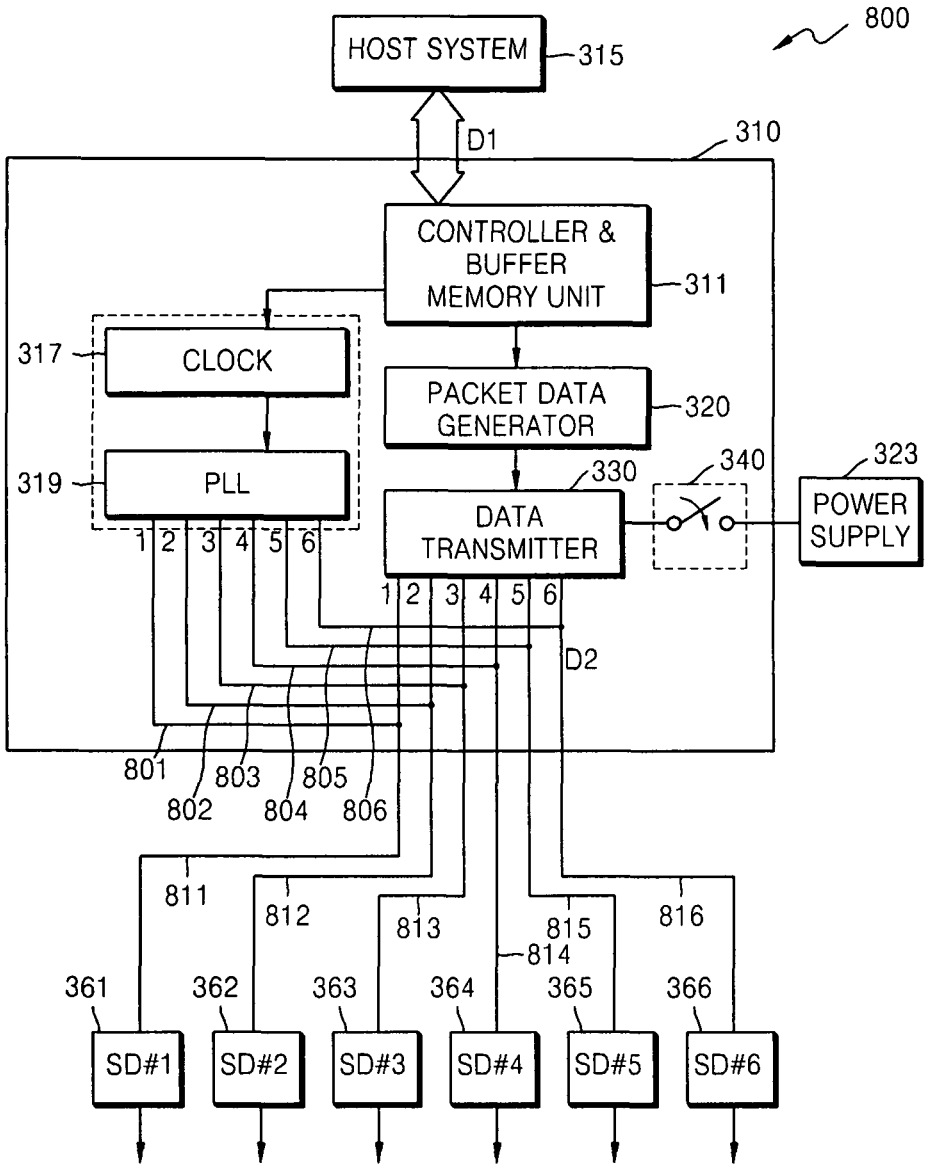
FIG. 6 illustrates a block diagram of an LCD apparatus according to another embodiment.

FIG. 6 illustrates a block diagram of an LCD 800 apparatus according to another embodiment. Referring to FIG. 6, each clock signal line 801 through 806 may be connected to a corresponding data signal line 811 through 816. Thus, each clock signal may be embedded in the corresponding data signal, and the resultant signal may be transmitted. That is, a clock signal may be combined with the corresponding second data D2 using an embedding technique, and the resultant data is transmitted to the source drivers SD on a single line, not via a separate first signal line part for clock signals as illustrated in FIG. 1A. The embedding technique is well-known to one of ordinary skill in the art.

As described above, in a LCD apparatus according to the present invention, by connecting a time controller and source drivers in a point-to-point fashion and transmitting output data of the time controller in the form of packet data, an amount of transmitted data may be increased and EMI may be reduced. Also, by using data in a packet format, IP blocks in a LCD apparatus may be reused. Furthermore, by preventing differential current from being supplied in a period for which no data is transmitted to source drivers through a switching unit, power consumption may be reduced.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of embodiments as set forth in the following claims.

What is claimed is:

1. A liquid crystal display apparatus, comprising:

a time controller configured to receive first data, and to output a plurality of clock signals and a plurality of pieces of second data to display the first data; and a plurality of source drivers configured to receive the plurality of pieces of second data and the plurality of clock signals from the time controller, convert the plurality of pieces of second data to a plurality of pieces of analog data, and output the plurality of pieces of analog data to a display panel, wherein:

the time controller and the plurality of source drivers have a point-to-point connection, and the second data have a packet data format, the time controller includes a packet data generator configured to convert the first data into the packet data format and output the converted packet data, and the packet data includes a payload part including information about one of a data loading time, a charge sharing time, and image data that is to be displayed, and a header having one of a plurality of predetermined values indicating whether the data of the payload part is a data loading time, a charge sharing time, or image data, and the number of the plurality of source drivers is n, the time controller outputs n clock signals having n different phases to the n source drivers, respectively, through the point to point connection, and the plurality of pieces of second data are respectively output at different times such that each of the plurality of source drivers identifies the information in the payload part of the corresponding one of the plurality of pieces of second data provided thereto according to the predetermined value of the header.

2. The liquid crystal display apparatus as claimed in claim 1, wherein the time controller comprises a delay line including a plurality of delay cells, and outputs the n clock signals having the different phases using the delay line.

3. The liquid crystal display apparatus as claimed in claim 1, wherein the packet data includes information regarding the data loading time at which image data is loaded into the display panel from the plurality of source drivers.

4. The liquid crystal display apparatus as claimed in claim 1, wherein the time controller further comprises:

a controller and buffer memory configured to receive and store the first data, and output a control signal for displaying the first data;

the packet data generator is configured to generate the plurality of pieces of second data in the form of packet data, using the first data; and a data output unit configured to output the plurality of pieces of second data to the plurality of source drivers, respectively.

5. The liquid crystal display apparatus as claimed in claim 1, wherein each packet data further comprises:

the payload part including information regarding the data loading time, a time required for loading, or a location of the loaded data; and the header indicating that data of the payload part is data about a loading time; and wherein the LCD apparatus adjusts a time at which the second data is loaded.

6. The liquid crystal display apparatus as claimed in claim 5, wherein, in the packet data, data loading times of the plurality of pieces of second data are set so that the plurality of pieces of second data are loaded at different times.

7. The liquid crystal display apparatus as claimed in claim 5, wherein the packet data is information regarding the charge sharing time which is a time required to change polarities of voltages applied to both ends of a pixel, or image information that is actually displayed.

8. The liquid crystal display apparatus as claimed in claim 1, wherein each source driver further comprises a decoder configured to receive and decode the packet data according to the predetermined value of the header, and obtain information regarding the data loading time and the charge sharing time from the result of the decoding.

9. The liquid crystal display apparatus as claimed in claim 1, wherein a size of the packet data is set differently according to the number of image signals included in the packet data.

10. The liquid crystal display apparatus as claimed in claim 1, wherein the point-to-point connection includes:

a plurality of first signal lines providing a point-to-point connection of the plurality of clock signals to the plurality of source drivers; and a plurality of second signal lines, separate from the plurality of first signal lines, providing a point-to-point connection of the plurality of pieces of second data to the plurality of source drivers.

11. The liquid crystal display apparatus as claimed in claim 1, the time controller configured to receive the image data that is to be displayed on one horizontal line of the display panel while a data enable signal is activated.

12. The liquid crystal display apparatus as claimed in claim 11, wherein, when the second data is transmitted, the LCD apparatus transmits the image data that is to be displayed on one horizontal line of the display panel, as one piece of packet data, to the plurality of source drivers.

13. The liquid crystal display apparatus as claimed in claim 11, wherein, when the second data is transmitted, the LCD apparatus divides the image data that is to be displayed on the one horizontal line of the display panel into at least two pieces of packet data, and transmits the divided packet data to the display panel.

14. The liquid crystal display apparatus as claimed in claim 1, wherein the time controller comprises a switching unit configured to supply or block supply of a differential current required to transmit the second data from a power supply.

15. The liquid crystal display apparatus as claimed in claim 14, wherein the time controller is configured to sense a time period for which the second data are not transmitted, and turn off the switching unit during the time period for which the second data is not transmitted, in response to the result of the sensing.

16. The liquid crystal display apparatus as claimed in claim 1, wherein the point-to-point connection includes a plurality of signal lines transmitting the plurality of clock signals and the plurality of pieces of second data, the plurality of clock signals being embedded in the plurality of pieces of second data.

17. The liquid crystal display apparatus as claimed in claim 1, wherein the point-to-point connection includes:

first signal lines connecting the plurality of clock signals to the plurality of source drivers, a number of clock signals being less than a number of source drivers; and a plurality of second signal lines, separate from the first signal lines, providing a point-to-point connection of the plurality of pieces of second data to the plurality of source drivers.

18. The liquid crystal display apparatus as claimed in claim 17, wherein each clock signal of the plurality of clock signals is supplied to at least two source drivers.

* * * * *